United States Patent [19]

Asakura et al.

[11] Patent Number: 4,771,755

[45] Date of Patent: Sep. 20, 1988

[54] ABNORMALITY DETECTING METHOD FOR AIR-FUEL RATIO CONTROL SYSTEM FOR INTERNAL COMBUSTION ENGINES

[75] Inventors: Masahiko Asakura; Hiroshi Hasebe; Shinichi Kubota; Yoshitaka Hibino; Koji Kajita; Atsushi Totsune, all of Wako, Japan

[73] Assignee: Honda Giken Kogyo K.K., Tokyo, Japan

[21] Appl. No.: 5,644

[22] Filed: Jan. 21, 1987

[30] Foreign Application Priority Data

| | | | |
|---|---|---|---|
| Jan. 22, 1986 | [JP] | Japan | 61-012354 |
| Jan. 22, 1986 | [JP] | Japan | 61-012355 |
| Oct. 30, 1986 | [JP] | Japan | 61-258990 |
| Oct. 30, 1986 | [JP] | Japan | 61-258991 |

[51] Int. Cl.[4] ..... F02D 41/22

[52] U.S. Cl. ..... 123/589

[58] Field of Search ..... 123/479, 480, 198 D, 123/585, 587, 588, 589

[56] References Cited

U.S. PATENT DOCUMENTS

| | | | |
|---|---|---|---|
| 4,380,985 | 4/1983 | Otsuka et al. | 123/589 X |
| 4,414,950 | 11/1983 | Otsuka et al. | 123/589 X |
| 4,450,812 | 5/1984 | Otsuka et al. | 123/589 X |
| 4,503,479 | 3/1985 | Otsuka et al. | 123/480 X |
| 4,531,490 | 7/1985 | Kishi et al. | 123/585 X |
| 4,583,176 | 4/1986 | Yamato et al. | 123/589 X |
| 4,690,121 | 9/1987 | Kawanabe et al. | 123/589 |

FOREIGN PATENT DOCUMENTS 0119941 9/1980 Japan .

*Primary Examiner*—Willis R. Wolfe

*Attorney, Agent, or Firm*—Arthur L. Lessler

[57] ABSTRACT

A method of detecting abnormality in an air-fuel ratio control system for an internal combustion engine, the air-fuel ratio control system having a proportional control valve arranged in an air supply passage for supplying secondary air therethrough to the engine and controlled in response to an output signal from an oxygen concentration sensor arranged in an exhaust system of the engine in a manner such that its valve opening varies in proportion to the magnitude of driving current supplied thereto. A circuit is provided which includes a first transistor, the proportional control valve, and a second transistor arranged in the order mentioned and serially connected with each other between a power source for supplying a predetermined voltage and ground. A value of voltage at a predetermined location in said circuit is sensed while the first and second transistors are in predetermined states of conduction and non-conduction. It is determined whether there is abnormality in the air-fuel ratio control system, on the basis of the sensed voltage value.

13 Claims, 7 Drawing Sheets

| |
|---|
| FIG.6A |
| FIG.6B |

ABNORMALITY DETECTING METHOD FOR AIR-FUEL RATIO CONTROL SYSTEM FOR INTERNAL COMBUSTION ENGINES

BACKGROUND OF THE INVENTION

This invention relates to a method of detecting abnormality in an air-fuel ratio control system for internal combustion engines, which employs a proportional control valve controlled in response to an output signal from a sensor for sensing oxygen concentration in exhaust gases, for controlling an amount of secondary air supplied to the engine.

An air-fuel ratio control system for internal combustion engines is already known, e.g. from Japanese Provisional Patent Publication (Kokai) No. 55-119941, which employs a proportional control valve arranged in an air supply passage for supplying secondary air therethrough to the engine and controlled in response to an output signal from an oxygen concentration sensor arranged in the exhaust system of the engine in such a manner that its valve opening varies in proportion to the magnitude of driving current supplied thereto.

The known air-fuel ratio control system is provided with a series circuit comprising a solenoid of the proportional control valve and a driving transistor serially connected between a power source which supplies a predetermined voltage and ground, wherein the valve opening of the proportional control valve, i.e. the amount of secondary air to be supplied to the engine is controlled in proportion to the magnitude of driving current supplied to the solenoid, which current is determined by duty ratio control of the driving transistor.

In the event of a short circuit occurring in the driving transistor or harness connecting between the driving transistor and the solenoid being short-circuited to ground due to biting or a like cause, the solenoid is continuously energized, i.e. energized with almost 100 percent duty ratio, as a result of which the proportional control valve is opened to the maximum degree so that an excessive amount of secondary air is supplied to the engine, resulting in overleaning of the air-fuel ratio of a mixture supplied to the engine and consequently on degraded combustion of the engine.

If such abnormality as a short circuit in the driving transistor is detected by sensing the value of a voltage at a specific location in the series circuit formed of the driving transistor, etc., detection of abnormality cannot be effected accurately while the engine is in a starting condition, since the above voltage sensed is fluctuating due to a drop in the output voltage of a battery feeding power to the starting motor during starting of the engine. This necessitates effecting detection of abnormality after completion of cranking of the engine and thereafter causing the driving transistor for the proportional control valve for secondary air amount control to be energized only when no abnormality has been detected. On the other hand, it is requisite that when the engine is restarted in a hot state, e.g. when it is restarted immediately after it has been stopped, an increased quantity of secondary air should be supplied to the engine for smooth starting of the engine. However, if the driving transistor is faulty, it can burn if it is energized before such faulty condition is detected.

SUMMARY OF THE INVENTION

It is an object of the invention to provide an abnormality detecting method for an air-fuel ratio control system employing a proportional control valve for controlling the amount of secondary air supplied to an internal combustion engine, which is capable of detecting without fail abnormalities in the control system, and also capable of preventing degradation in the combustion state of the engine which would otherwise be caused by overleaning of the air-fuel ratio of a mixture supplied to the engine which can occur when the control system is faulty.

It is a further object of the invention to provide an abnormality detecting method of this kind, which also has a function of enabling smooth starting of the engine when the engine is restarted in a hot state.

To attain the above objects, the present invention provides a method of detecting abnormality in an air-fuel ratio control system for an internal combustion engine, the air-fuel ratio control system having a proportional control valve arranged in an air supply passage for supplying secondary air therethrough to the engine and controlled in response to an output signal from an oxygen concentration sensor arranged in an exhaust system of the engine in a manner such that a valve opening thereof varies in proportion to the magnitude of driving current supplied thereto.

According to a first aspect of the invention, the method according to the invention is characterized by comprising the following steps: (1) providing a circuit including a first transistor, the proportional control valve, and a second transistor arranged in the order mentioned and serially connected with each other between a power source for supplying a predetermined voltage and ground; (2) sensing a value of voltage at a predetermined location in the circuit while the first and second transistors are in predetermined states of conduction and non-conduction; and (3) determining whether there is abnormality in the air-fuel ratio control system, on the basis of the sensed voltage value.

According to a second aspect of the invention, the method according to the invention is characterized by comprising the following steps: (1) providing a circuit including a first transistor, the proportional control valve, and a second transistor arranged in the order mentioned and serially connected with each other between a power source for supplying a predetermined voltage and ground; (2) sensing a value of voltage at a predetermined location in the circuit while the first and second transistors are in predetermined states of conduction and non-conduction; (3) determining whether there is abnormality in the air-fuel ratio control system, on the basis of the sensed voltage value; (4) holding the first transistor in a non-conducting state when the engine is starting in a state other than a predetermined hot state; (5) determining whether it was determined at the step (3) that there was abnormality in the air-fuel ratio control system, during immediately preceding operation of the engine before the engine stops; and (6) causing the first transistor to conduct when the engine is starting in the predetermined hot state, if it is determined at the step (5) that there was no abnormality in the air-fuel ratio control system during the immediately preceding operation of the engine.

The above and other objects, features and advantages of the invention will be more apparent from the ensuing detailed description taken in conjunction with the accompanying drawings.

DETAILED DESCRIPTION

The invention will now be described in detail with reference to the drawings showing embodiments thereof.

Figure 1:
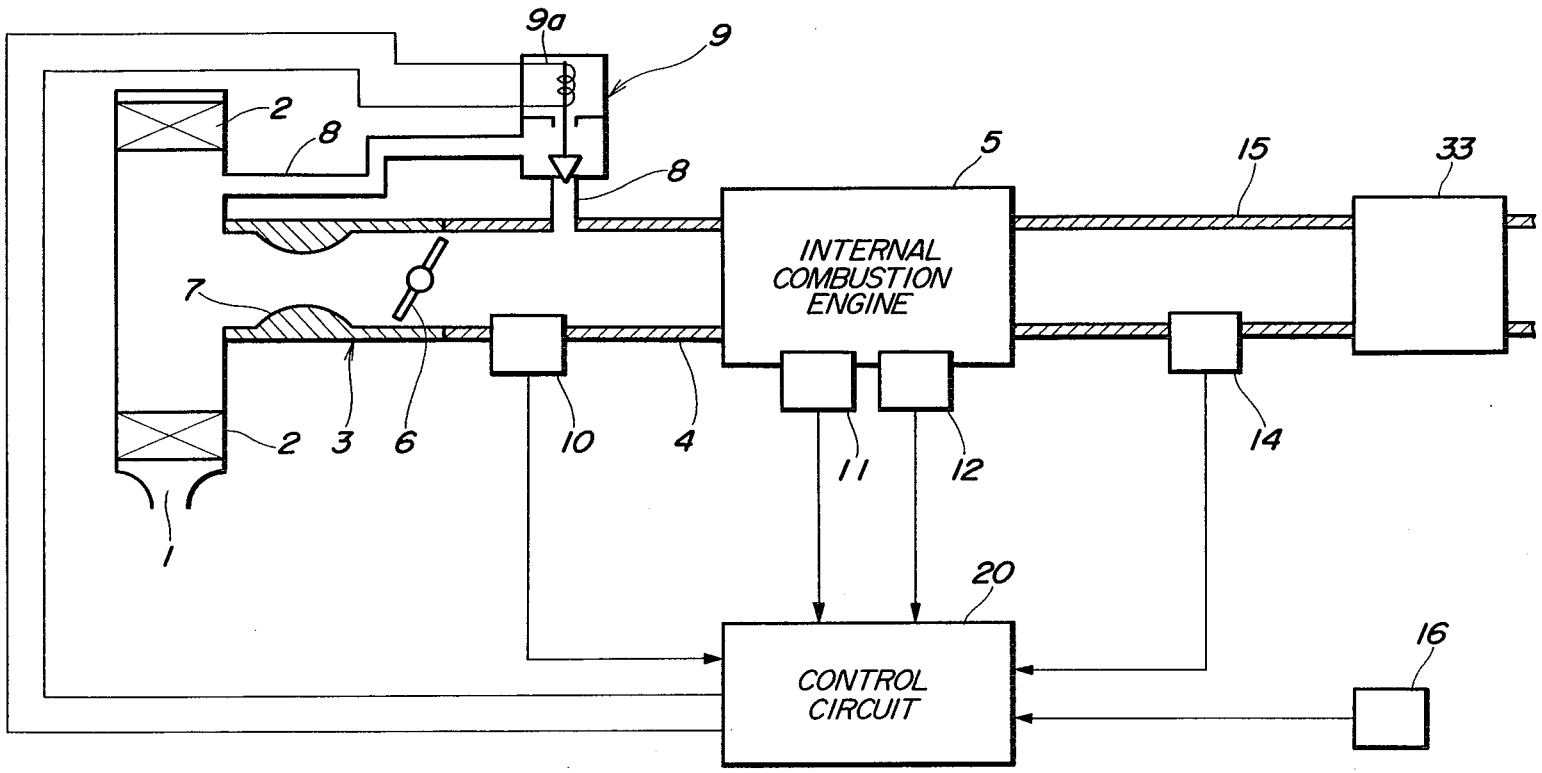
FIG. 1 is a block diagram of the overall arrangement of an internal combustion engine provided with an air-fuel ratio control system, to which is applied the method of the invention.

Referring first to FIG. 1, there is illustrated the overall arrangement of an internal combustion engine of the carburetor type, which is provided with an air-fuel ratio control system for practising the method of the invention.

In FIG. 1, reference numeral 5 designates an internal combustion engine which may be a four-cylinder type, for example. An intake pipe 4 extends from the intake side of the engine 5, and is provided with an air inlet 1, an air cleaner 2, and a carburetor 3 of a known type having a venturi 7. A throttle valve 6 is arranged in the intake pipe 4 at a location downstream of the venturi 7. Reference numeral 8 designates a secondary air supply passage which communicates at one end thereof with the air cleaner 2 upstream of the venturi 7 and at the other end with the intake pipe 4 at a location downstream of the throttle valve 6, and across which is arranged an electromagnetic valve 9 of a linear solenoid type as a proportional control valve. The electromagnetic valve 9 has a solenoid **9*a* thereof connected to a control circuit (hereinafter called "the ECU") 20, to be controlled by the ECU 20 to supply the engine with secondary air in an amount proportionate to the magnitude of driving current supplied thereto from the ECU 20. An absolute pressure (PB) sensor 10 is connected to the interior of the intake pipe 4 at a location downstream of the throttle valve 6, for supplying an output signal indicative of the sensed absolute pressure in the intake pipe 4 to the ECU 20**.

An engine coolant temperature (TW) 12 is mounted on the cylinder block of the engine 5, which may be formed of a thermistor, for example, and inserted into the peripheral wall of one of the engine cylinders filled with engine coolant, for supplying an output signal indicative of the sensed coolant temperature to the ECU 20.

An engine rotational speed (Ne) sensor (hereinafter called "the Ne sensor") 11 is arranged in facing relation to a camshaft or a crankshaft of the engine, neither of which is shown, and is adapted to generate a pulse as an engine rotational speed signal at a predetermined crank angle before top dead center of each of the engine cylinders each time the crankshaft rotates through 180 degrees, the signal being supplied to the ECU 20.

A three-way catalyst 33 is provided in an exhaust pipe 15 extending from the exhaust side of the engine 5 for purifying HC, CO, and NOx contained in the exhaust gases emitted from the engine. Arranged upstream of the three-way catalyst 33 is an $O_2$ sensor 14 as an oxygen concentration sensor, for sensing oxygen concentration in the exhaust gases and supplying an output signal indicative of the sensed concentration value to the ECU 20.

Further connected to the ECU 20 is a power source 16 such as a battery for supplying a predetermined operating voltage to the ECU 20.

The ECU 20 determines operating conditions of the engine 5 on the basis of output signals indicative of engine operating parameters from the above-mentioned various sensors, controls the amount of fuel to be supplied to the venturi 7 from a carburetor, not shown, to values commensurate with the determined engine operating conditions, and also controls the amount of secondary air to be supolied to the engine by varying the duty ratio at which the electromagnetic valve 9 is energized, in response to an output signal from the $O_2$ sensor 14 to thereby bring the air-fuel ratio of a mixture supplied to the engine to desired values.

Figure 2:
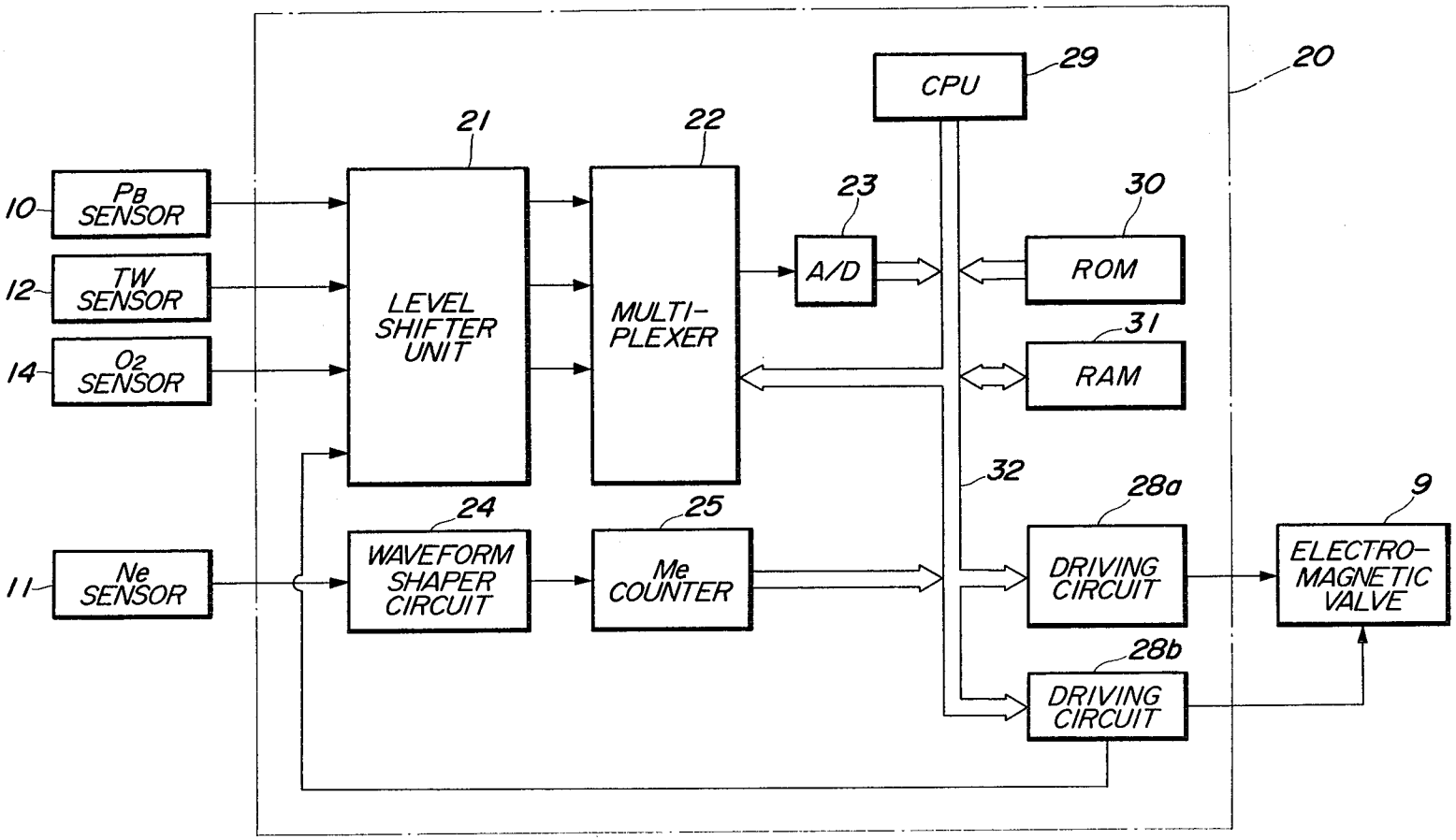
FIG. 2 is a block diagram of the internal arrangement of a control circuit (ECU) appearing in FIG. 1.

FIG. 2 shows a circuit configuration within the ECU 20 in FIG. 1. The engine rotational speed signal from the Ne sensor 11 has its waveform shaped by a waveform shaper circuit 24, and the shaped signal is supplied to an Me counter 25, which in turn counts the time interval between an immediately preceding pulse of the engine rotational speed signal inputted to the ECU 20 and a present one thereof to obtain a counted value Me which is proportional to the reciprocal of the engine rotational speed Ne. The Me counter 25 supplies the counted value Me to a central processing unit (hereinafter called "the CPU") 29 via a data bus 32.

Output signals from the absolute pressure (PB) sensor 10, the engine coolant temperature (TW) sensor 12, the $O_2$ sensor 14, etc. have their voltage levels shifted to a predetermined level by a level shifter unit 21, and the level-shifted signals are successively supplied to an analog-to-digital (A/D) converter 23 by a multiplexer 22. The analog-to-digital converter 23 successively converts the signals from the above-mentioned sensors into digital signals, which are then supplied to the CPU 29 via the data bus 32.

Further connected to the CPU 29 are a read-only memory (ROM) 30, a random access memory (RAM) 31, and driving circuits **28*a*, 28*b*. The RAM 31 temporarily stores results of calculations effected within the CPU 29, and the ROM 30** stores programs for detecting fault in the air-fuel ratio control system, hereinafter described in detail, etc.

The CPU 29, as stated before, determines various engine operating conditions from output signals from various engine operating parameter sensors, and supplies a control signal commensurate with the determined engine operating conditions to a fuel quantity control valve, not shown, of the carburetor. It also calculates the duty ratio at which the electromagnetic valve 9 is energized, in response to the output signal from the $O_2$ sensor and supplies a duty ratio control signal IOUT indicative of the calculated duty ratio to the driving circuit **28*b* which drives the electromagnetic valve 9, via the data bus 32. The driving circuit 28*b* in turn supplies the electromagnetic valve 9 with a driving signal for energizing same with a duty ratio corresponding to the duty ratio control signal IOUT. Further, as described in detail later, the CPU 29 supplies the driving circuit 28***a*which is provided for fault detection, with a fault detecting signal for selectively energizing and deenergizing a driving transistor within the driving circuit 28*a*.

Figure 3:
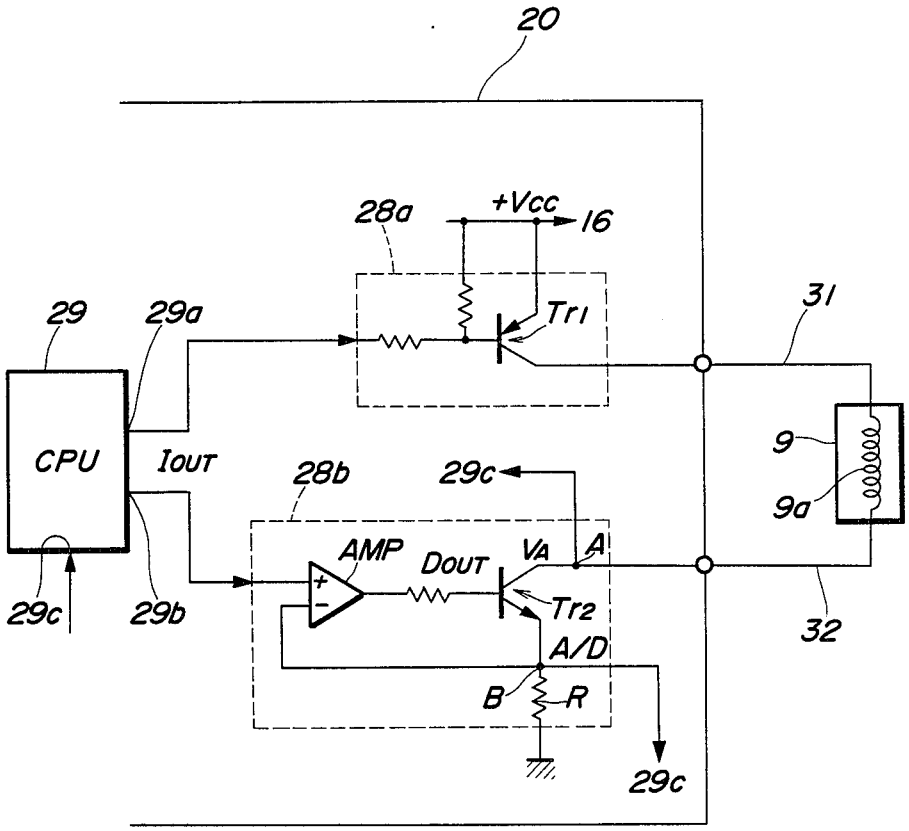
FIG. 3 is a circuit diagram showing a connection between the control circuit and an electromagnetic valve 9 appearing in FIG. 1.

FIG. 3 shows a manner of connection between the control circuit for the electromagnetic valve 9, i.e. the driving circuits 28*a*, 28*b* and the electromagnetic valve 9. As shown in the figure, connected in series between the power source 16 supplying a predetermined voltage +Vcc and ground are a first transistor Tr1 of the fault detection driving circuit 28*a*, the solenoid 9*a* of the electromagnetic valve 9, a second transistor Tr2 of the driving circuit 28*b* for control of the electromagnetic valve 9, and a resistance R in the order mentioned. To be specific, the first transistor Tr1 of the fault detection driving circuit 28*a* has its emitter connected to the power source 16, its collector to a harness 31 connected to one end of the solenoid 9*a* of the electromagnetic valve 9, and its base to an output terminal 29*a* of the CPU 29 through which the fault detecting signal is outputted, respectively. On the other hand, the second transistor Tr2 of the valve control driving circuit 28*b* has its collector connected to a harness 32 connected to the other end of the solenoid, its emitted to one end of the resistance R grounded at the other end, and its base to an output of an amplifier AMP, respectively. The amplifier AMP has its non-inverting input terminal connected to an output terminal 29*b* of the CPU 29 through which the duty ratio control signal IOUT is outputted, and its inverting input terminal to a junction of the emitter of the second transistor Tr2 with the resistance R, respectively. Further, a first fault detecting point A is provided at a junction between the electromagnetic valve 9 and the second transistor Tr2, i.e. at the collector of the second transistor Tr2, the point A being connected to an input terminal 29*c* of the CPU 29 through which a fault-indicative signal is inputted. Also, a second fault detecting point B is provided at a junction of the emitter of the second transistor Tr2 with the one end of the resistance R and also connected to the above-mentioned input terminal 29*c* of the CPU 29.

With the above arrangement, during normal operation of controlling the secondary air amount described before, the CPU 29 supplies a low level signal to the first transistor Tr1 of the fault detection driving circuit 28*a* to hold it in conduction and at the same time supplies the second transistor Tr2 of the valve control driving circuit 28*b* with the duty ratio control signal IOUT calculated in response to the output signal from the $O_2$ sensor 14 to thereby energize the second transistor Tr2 with a duty ratio determined by the control signal IOUT. On the other hand, the CPU 29 performs fault detection on the basis of a voltage level VA at the first fault detecting point A or a voltage level A/D at the second fault detecting point B with the first and second transistors Tr1, Tr2 conducting or non-conducting in predetermined manners, as described in detail hereinafter.

Figure 4:
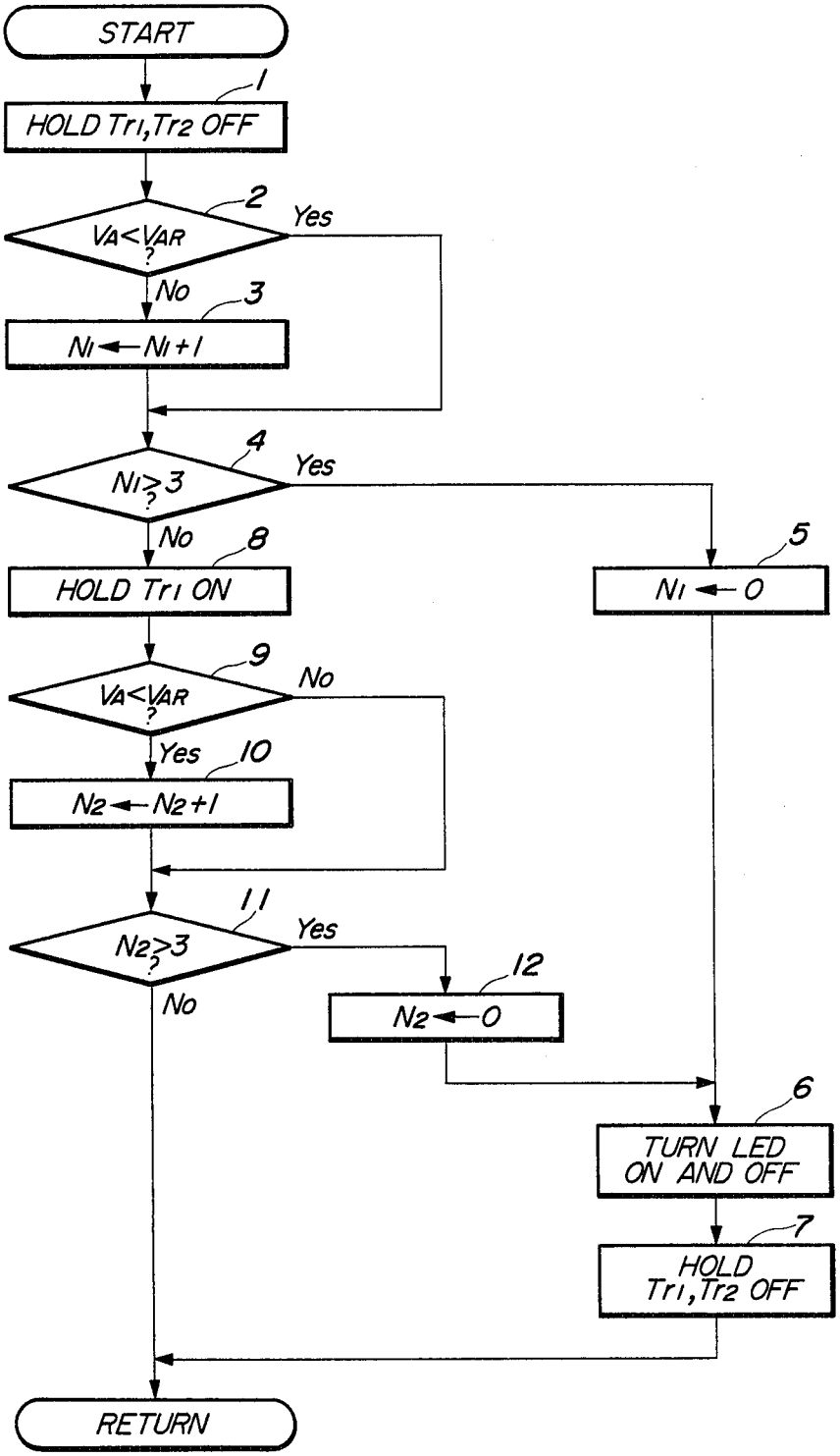
FIG. 4 is a flowchart of a program for detecting abnormality according to a first embodiment of the invention.

FIG. 4 shows a flowchart of a program for carrying out the fault detection according to a first embodiment of the invention. This program is executed when the control circuit of FIG. 3 is inoperative or in stop mode wherein the duty ratio control signal IOUT supplied to the electromagnetic valve 9 indicates a duty ratio of zero. A step 1 in FIG. 4 calls for rendering both of the first and second transistors Tr1, Tr2 of the driving circuits 28*a*, 28*b* in FIG. 3 nonconducting (OFF), and a step 2 for a determination as to whether the voltage VA at the first fault detecting point A in FIG. 3 is lower than a predetermined value VAR (e.g. 1 volt). If the first and second transistors Tr1, Tr2 are both off, the voltage VA at the fault detecting point A should be 0 volt if the control circuit of FIG. 3 is normally or properly functioning. Therefore, if the answer to the question of the step 2 is affirmative or Yes, it is assumed that the control circuit of FIG. 3 is in a normal state, and then the program jumps to a step 4. On the other hand, if the answer at the step 2 is negative or No, that is, if the voltage VA is higher than the predetermined value VAR, it is considered that there is a fault in the FIG. 3 control circuit at a portion thereof between the electromagnetic valve 9 and the power source 16 (e.g. a short circuit in the first transistor Tr1 or short-circuiting of the harness 31 connecting between the transistor Tr1 and the solenoid 9*a* to the power source 16 due to biting or the like). Thus when the answer at the step 2 is negative or No, it is assumed that there is some fault at the above portion of the FIG. 3 control circuit, followed by execution of a step 3 to add 1 to a count N1 which indicates the number of times of detection of fault at the control circuit portion.

The step 4 determines whether the count N1 exceeds a predetermined number, e.g. 3. If the answer is affirmative or Yes, it is finally decided that the fault really exists at the control circuit portion. By thus repeatedly executing fault detection several times before finally deciding the existence of a fault at the same control circuit portion, it is possible to avoid a wrong diagnosis from being rendered due to noise, etc. The affirmative answer to the step 4 causes steps 5, 6 and 7 to be executed wherein the count N1 is reset to 0, and a warning action is performed, e.g. by alternately turning on and off an LED, and a fail-safe action is executed, e.g. by cutting off (OFF) the first and second transistors Tr1, Tr2 to cause the solenoid 9*a* to be deenergized, respectively, followed by termination of the program. Since the solenoid 9*a* is thus deenergized at the step 7, overleaning of the air-fuel ratio of the mixture supplied to the engine can be prevented on the occasion of occurrence of a fault in the FIG. 3 control circuit.

If the answer to the question of the step 2 is affirmative or Yes and at the same time it is determined at the step 4 that the count N1 does not exceed 3, a step 8 is executed to cause the first transistor Tr1 to conduct (ON), followed by execution of a step 9 to determine whether the voltage VA at the first fault detecting point A is lower than the predetermined value VAR. Since in the present case the second transistor Tr2 has been rendered non-conducting at the step 1 as stated before, the voltage VA at the point A should be higher than the predetermined value VAR if the FIG. 3 control circuit is normally functioning. Therefore, if the answer at the step 9 is negative or No, it is then assumed that the control circuit is normal, and the program jumps to a step 11. On the other hand, if the answer at the step 9 is affirmative or Yes, that is, if the voltage VA is lower than the predetermined value VAR, it is considered that there is a fault in the FIG. 3 control circuit at a portion thereof between the electromagnetic valve 9 and ground (e.g. a short circuit in the second transistor Tr2 or short-circuiting of the harness 32 connecting between the transistor Tr2 and the solenoid 9*a* to ground due to biting or the like). Thus, upon the affirmative answer at the step 9 being obtained, 1 is added to a second count N2 indicative of the number of times of detection of fault at the control circuit portion between the electromagnetic valve 9 and ground. The step 11 calls for a determination as to whether the second count N2 exceeds a predetermined number, e.g. 3. If the answer is affirmative or Yes, a final decision is rendered to the effect that the fault really exists at the control circuit portion, and the second count N2 is reset to 0 at a step 1, followed by execution of the steps 6 and 7 to perform the aforementioned warning action and fail-safe action. Then, the program terminates. If on the other hand the second count N2 does not exceed the predetermined number 3, the program is immediately terminated.

According to the first embodiment described above, it is possible to detect faults at a plurality of portions of the control circuit for the electromagnetic valve 9 merely by monitoring a voltage or potential at a single point in the control circuit, thus simplifying the arrangement or construction of the fault detection system.

Although in the above described embodiment an LED is turned on and off for giving a warning both at the time of occurrence of abnormality in a control circuit portion between the electromagnewtic valve 9 and the power source 16 and at the time of occurrence of abnormality in a control circuit portion between the valve 9 and ground, an exclusive warning means or LED may alternatively be provided for each of the control circuit portions, whereby an abnormality location can be identified immediately upon occurrence of the abnormality.

Figure 5:
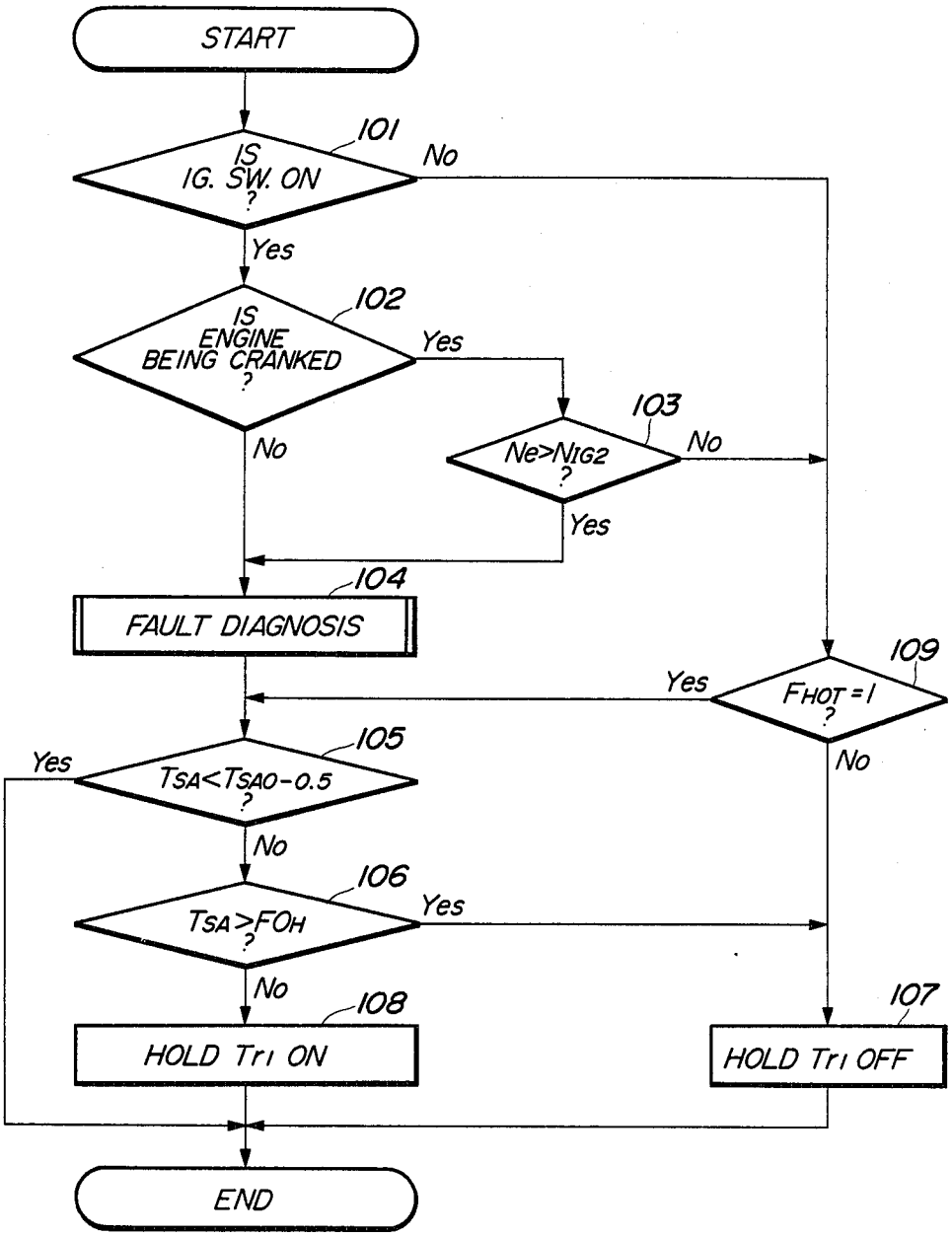
FIG. 5 is a flowchart of a program for detecting abnormality according to a second embodiment of the invention.

FIG. 5 shows a flowchart of a program for fault detection according to a second embodiment of the invention.

First, a step 101 calls for a determination as to whether the ignition switch of the engine is closed (ON) or not. If the answer is affirmative or Yes, a step 102 is executed to determine whether the engine is being cranked. If the answer at the step 102 is affirmative or Yes, it is determined at a step 103 wether the engine rotational speed Ne is higher than a predetermined value NIG2 (e.g. 2000 rpm), while if the answer at the step 102 is No, the program proceeds to a step 109, hereinafter described. The step 103 is effective to make up for a wrong decision as to whether the engine is being cranked at the step 102, as caused by failure of the starting switch of the engine indicative of whether the engine starting motor is operative. If the answer to the question of the step 103 is affirmative or Yes, it is regarded that the answer at the step 102 is incorrect, and then the program proceeds to a step 104 to execute a fault diagnosis subroutine for detecting a fault in the air-fuel ratio control system, which step is also executed when the answer at the step 102 is negative or No, i.e. when the engine is not in a cranking state.

Figure 6A:
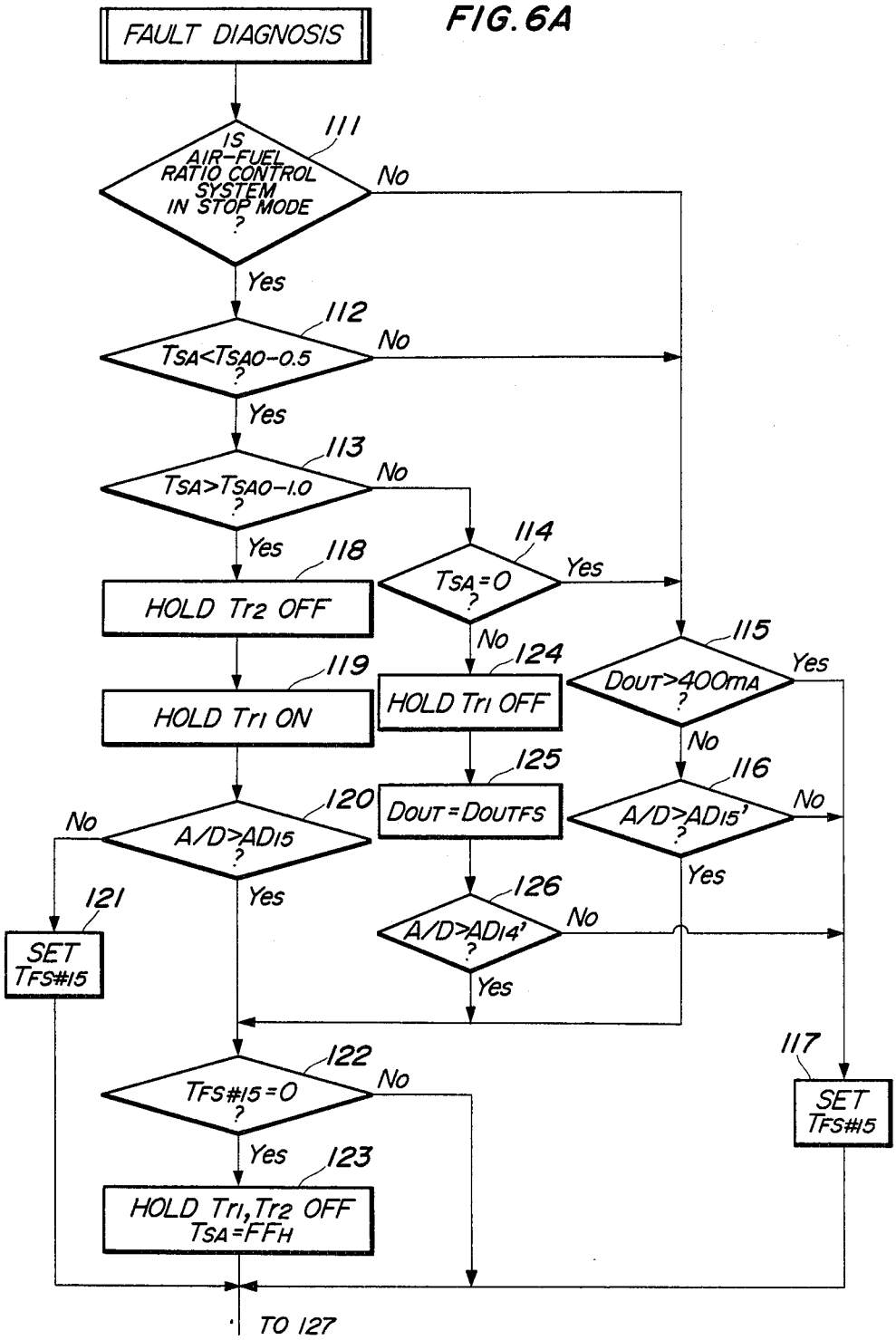
FIGS. 6, 6A and 6B are a flowchart of a fault diagnosis subroutine for the air-fuel ratio control system, which is executed in step 104 in FIG. 5.
Figures 6, 6B:
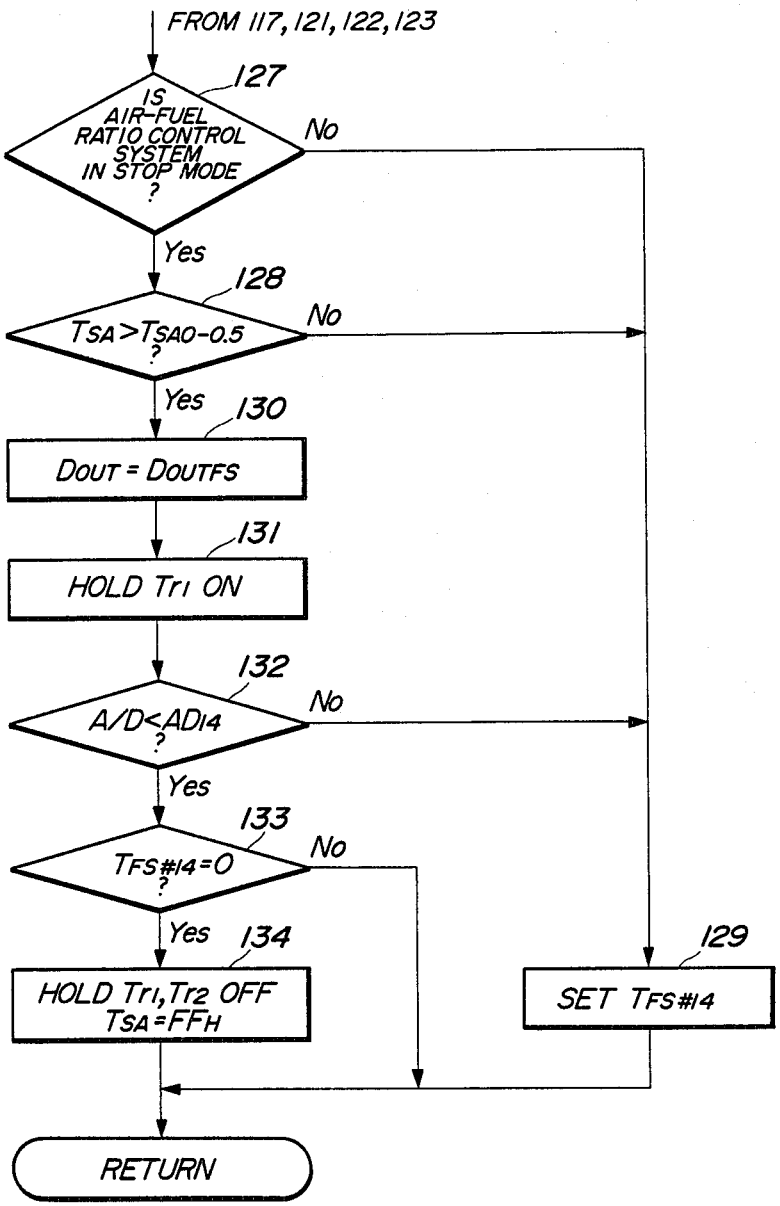

FIG. 6 shows a flowchart of the fault diagnosis subroutine referred to above, and executed by the step 104 in FIG. 5. In this second embodiment, fault detection is effected on the basis of the voltage A/D at the second fault detecting point B in FIG. 3.

First, at a step 111 of FIG. 6, it is determined whether the air-fuel ratio control system is inoperative (i.e. in "stop" mode), that is, whether the duty ratio control signal IOUT applied to the electromagnetic valve 9 shows a duty ratio of 0. If the answer is affirmative or Yes, a step 112 is executed to determine the value of a count in a TSA timer which comprises a down counter and is started (initialized) when the ignition switch is determined to have been turned on or closed. When the engine has started up, the TSA timer is initialized by being set to a predetermined time period TSA0 (e.g. 2.0 sec), and thereafter the timer count TSA is counted down or decreased from the initial value TSA0 with the lapse of time. The step 112 determines whether the count TSA has become smaller than TSA0−0.5 (=1.5 sec), that is, whether 0.5 seconds have elapsed after the closing of the ignition switch. If the answer is affirmative or Yes, a step 113 is executed to determine whether the count TSA is larger than TSA0−1.0 (=1.0 sec), that is, whether 1.0 second has elapsed after the closing of the ignition switch. If the answer to the question of the step 113 is negative or No, it is determined at a step 114 whether the count TSA has become 0 (=0.0 sec), that is, whether 2 seconds have elapsed after the closing of the ignition switch so that the TSA timer has run out of time.

If the answer at the step 112 is negative or No, or if the answer at the step 114 is affirmative or Yes (that is, if the time elapsed after the closing of the ignition switch is less than 0.5 sec or more than 2.0 sec), or if the answer at the step 111 is negative or No, the program proceeds to a step 115 wherein it is determined whether an output current DOUT from the amplifier AMP of the driving circuit **28*b* in FIG. 3 is larger than 400 mA. If the answer at the step 115 is negative or No, it is determined at a step 116 whether the voltage A/D at the second fault detecting point B in FIG. 3 is higher than a predetermined value AD15′ (e.g. 0.95 volts). If the answer at the step 115 is negative or No, that is, if the output current from the amplifier AMP is smaller than 400 mA, the voltage A/D at the second fault detecting point B in FIG. 3 should show a very low value so long as the control circuit of FIG. 3 is normally functioning. Therefore, if the answer at the step 116 is negative or No, it is assumed that the FIG. 3 control circuit is normally functioning, and then a TFS#15 timer, which comprises a down counter is set and started to count over a predetermined time period, at a step 117. This step 117 is followed by execution of a step 127 et seq. On the other hand, if the answer at the step 116 is affirmative or Yes, that is, if the voltage A/D is higher than the predetermined value AD15′, it is considered that there is a fault in the FIG. 3 control circuit at a portion thereof between the electromagnetic valve 9 and ground (e.g. a short circuit in the second transistor Tr2) or the solenoid 9*a* is defective because of its impedance being too small. Then a step 122 is excecuted to determine whether the count in the TFS#15 timer has become zero. If the count has become zero, a fail-safe action for abnormality is effected at a step 123 by cutting the first and second transistors Tr1, Tr2 off (OFF) to deenergize the solenoid 9*a*, and the count in the TSA timer is set to a value FFH according to hexadecimal notation, which corresponds to infinity. If the answer at the step 122 is negative or No, the program skips over the step 123 to the step 127, so that no fail-safe action for abnormality is effected in order to avoid a wrong diagnosis from being rendered due to noise or the like. Incidentally, if the answer at the step 115 is affirmative or Yes, the program proceeds to the step 117**, on the assumption that the control circuit is normally functioning.

If the answer at the step 113 is affirmative or Yes, that is, if the time elapsed from the closing of the ignition switch is more than 0.5 sec and less than 1.0 sec, the program proceeds to a step 118 et seq. wherein the second transistor Tr1 of the driving circuit 28b in FIG. 3 is rendered non-conducting at the step 118, the first transistor Tr1 of the driving circuit 28a in FIG. 3 is rendered conducting at a step 119, and it is determined at a step 120 whether the voltage A/D at the second fault detecting point B in FIG. 3 is higher than a predetermined value AD15 (e.g. 1.3 volts). If the second transistor Tr2 is turned off and the first transistor Tr1 is turned on at the steps 118 and 119, the voltage A/D at the fault detecting point B should be zero if the FIG. 3 control circuit is properly functioning. Therefore, when the answer at the step 120 is negative or No, the TFS#15 timer is set and started at a step 121 on the assumption that the control circuit is normally functioning, followed by execution of the step 127 et seq. On the other hand if the answer at the step 120 is affirmative or Yes, that is, if the voltage A/D is higher than the predetermined value AD15, it is considered that there is a fault in the FIG. 3 control circuit at a portion thereof between the electromagnetic valve 9 and ground (e.g. a short circuit in the second transistor Tr2), and then the program proceeds to the step 122 et seq.

If the answer at the step 114 is negative or No, that is, if the time elapsed from the closing of the ignition switch is more than 1.0 sec and less than 2.0 sec, the program proceeds to a step 124. At the step 124, the first transistor Tr1 of the driving circuit 28a in FIG. 3 is rendered non-conducting (OFF). Then, at a step 125 the output current DOUT from the amplifier AMP in FIG. 3 is set to a predetermined value DOUTFS (e.g. 150 mA) which is so small as to keep the control valve 9 closed. Then, at a step 126 it is determined whether the voltage A/D at the second fault detecting point B in FIG. 3 is higher than a predetermined value AD14′ (e.g. 0.5 volts). After the above steps 124 and 125 are executed, the voltage A/D at the point B should be zero so long as the FIG. 3 control circuit is normally functioning. Therefore, when the answer at the step 126 is negative or No, the program proceeds to the step 117 on the assumption that the control circuit is normally functioning. On the other hand, if the answer at the step 126 is affirmative or Yes, that is, if the voltage A/D is higher than the predetermined value, it is considered that there is a fault in the FIG. 3 control circuit at a portion thereof between the electromagnetic valve 9 and the power source 16 (e.g. a short circuit in the first transistor Tr1), and hence the program proceeds to the step 122 et seq.

At the steps 127 et seq., a further abnormality detection processing is carried out. First, at the step 127 it is determined whether the air-fuel ratio control system is inoperative or in stop mode. If the answer is affirmative or Yes, it is determined at a step 128 whether the value TSA is larger than TSA0−0.5 (=1.5 sec), that is, if the time elapsed from the closing of the ignition switch is less than 0.5 sec. If the answer is affirmative or Yes, the output current DOUT from the amplifier AMP is set to the predetermined value DOUTFS at a step 130, the first transistor Tr1 of the driving circuit 28a is rendered conducting (ON), and a determination is made at a step 132 as to whether the voltage A/D at the point B is lower than a predetermined value AD14 which is very low (e.g. 0.5 volts). After execution of the steps 130 and 131 the voltage A/D at the point B should show a predetermined value which is not very low if the FIG. 3 control circuit is properly functioning. Therefore, when the answer at the step 132 is negative or No, a TFS#14 timer which comprises a down counter is set and started to count over a predetermined period of time at a step 129, on the assumption that the FIG. 3 control circuit is properly functioning, followed by termination of the program. On the other hand, if the answer at the step 132 is affirmative or Yes, that is, if the voltage A/D is lower than the predetermined value AD14, it is considered that there is a fault in the FIG. 3 control circuit (e.g. the first transistor Tr1 being short-circuited to ground or a disconnection in the first or second transistor Tr1 or Tr2, or a disconnection in the solenoid 9a, or the solenoid 9a being short-circuited to ground. Therefore, at a step 133 it is determined whether the TFS#14 timer has its count equal to zero, and if the answer is affirmative or Yes, like the step 123 described before, a fail-safe action for abnormality is executed at a step 134 to render the first and second transistors Tr1, Tr2 non-conducting to deenergize the solenoid 9a, and set the count in the TSA timer to a value FFH according to hexadecimal notation and corresponding to infinity, followed by termination of the program. If the answer at the step 133 is negative or No, the step 134 is skipped over, immediately followed by termination of the program. If the answer at the step 128 is negative or No, the aforementioned step 129 is executed, followed by termination of the program.

Referring again to FIG. 5, a step 105 follows after execution of the step 104, at which it is determined whether the value TSA has become smaller than TSA)−0.5 (=1.5 sec), that is, whether 0.5 seconds have elapsed after the closing of the ignition switch. If the answer is negative or No, it is determined at a step 106 whether the TSA value is larger than a value FOH according to hexadecimal notation. If the answer at the step 106 is affirmative or yes, it means that a fault has been found in the air-fuel ratio control system by the fault detection diagnosis subroutine of FIG. 6 described above, whereby the TSA value has been set to FFH. Hence the first transistor Tr1 is rendered non-conducting (OFF), at a step 107, followed by termination of the program. In this way, if a fault is found in the air-fuel ratio control system during immediately preceding operation of the engine, the first transistor Tr1 is turned off when the engine is again started after stoppage, thus preventing any trouble such as burning of the transistor Tr1 from occurring. On the other hand, if the answer at the step 106 is negative or No, it means that no fault has been found in the air-fuel ratio control system, and hence the first transistor Tr1 is caused to conduct (ON) at a step 108, followed by termination of the program. If the answer at the step 105 is affirmative or Yes (namely, 0.5 seconds have elapsed), normal operation (if no fault occurs) or a fail-safe action (if a fault occurs) is carried out at the step 104, so that the present program then does not need to carry out such operation or fail-safe action. Therefore, the step 105 is immediately followed by termination of the program.

On the other hand, if the answer to the question of either the step 101 or the step 103 is negative or No, it is determined at the step 109 whether a flag FHOT has been set to 1. This flag is set to 1, during execution of a program different from the present program, when the engine is restarted in a hot state immediately after it has been stopped. If the answer at the step 109 is affirmative or Yes, the program then proceeds to the aforementioned step 105. In this case, during the present operation of the engine the step 105 has not been executed as yet. However, the TSA value assumes a value set during the last operation of the engine. That is, if any fault was found in the driving transistors, etc. it has been set to FFH, whereas if no fault was found, it has been set to a value smaller than FOH. Therefore, if during the last operation of the engine a fault was found in the second transistor Tr2, etc., the answer at the step 106 is affirmative or Yes. Then, at the step 107 the first transistor Tr1 is rendered non-conducting to thereby prevent burning of the second transistor Tr2. On the other hand, if no fault was found in the second transistor tr2, etc. during the last operation of the engine, the answer at the step 106 becomes negative or No, then at the step 108 the first transistor Tr2 is caused to conduct to thereby enable smooth starting of the engine upon restarting in a hot state. If the answer to the step 109 is negative or No, it means that the engine is starting in a cold state, and then the first transistor Tr1 is made non-conducting, followed by termination of the program.

According to the second embodiment described above, in addition to the effect obtainable by the first embodiment that it is possible to detect faults at a plurality of portions of the control circuit for the electromagnetic valve 9 merely by monitoring a voltage or potential at a single point in the control circuit, thus simplifying the arrangement or construction of the fault detection system, it is also possible to accurately detect abnormalities at a plurality of portions of the control circuit both when the control circuit is operative and when it is inoperative or in stop mode.

What is claimed is:

1. A method of detecting abnormality in an air-fuel ratio control system for an internal combustion engine, said air-fuel ratio control system having a proportional control valve arranged in an air supply passage for supplying secondary air therethrough to the engine and controlled in response to an output signal from an oxygen concentration sensor arranged in an exhaust system of the engine in a manner such that a valve opening thereof varies in proportion to the magnitude of driving current supplied thereto, the method comprising the steps of:

(1) providing a circuit including a first transistor, said proportional control valve, and a second transistor, said control valve being connected between said first and second transistors, said first transistor, control valve and second transistor being serially connected with each other between a power source for supplying a predetermined voltage and ground;

(2) sensing a value of voltage at a predetermined location in said circuit while said first and second transistors are in predetermined states of conduction and non-conduction; and (3) determining whether there is abnormality in said air-fuel ratio control system, on the basis of the sensed voltage value.

2. A method as claimed in claim 1, wherein a value of voltage at a junction of said proportional control valve with said second transistor is sensed while said first and second transistors are both non-conducting, and it is decided that there is abnormality in said air-fuel ratio control system when the sensed voltage value is higher than a predetermined value.

3. A method as claimed in claim 2, wherein it is decided that there is a fault in said circuit at a portion thereof between said proportional control valve and said power source when the sensed voltage value is higher than said predetermined value.

4. A method as claimed in claim 1, wherein a value of voltage at a junction of said proportional control valve with said second transistor is sensed while said first transistor is conducting and at the same time said second transistor is non-conducting, and it is decided that there is abnormality in said air-fuel ratio control system when the sensed voltage value is lower than a predetermined value.

5. A method as claimed in claim 4, wherein it is decided that there is a fault in said circuit at a portion thereof between said proportional control valve and said ground when the sensed voltage value is lower than said predetermined value.

6. A method as claimed in claim 1, wherein when said proportional control valve is operative, a value of voltage at a junction of said second transistor with said ground is sensed while a predetermined amount of current is applied to a base of said second transistor, and it is decided that there is abnormality in said air-fuel ratio control system when the sensed voltage value falls outside a predetermined range.

7. A method as claimed in claim 1, wherein a value of voltage at a junction of said second transistor with said ground is sensed while a predetermined amount of current is applied to a base of said second transistor and at the same time said first transistor is conducting, and it is decided that there is abnormality in said air-fuel ratio control system when the sensed voltage value falls outside a predetermined range.

8. A method as claimed in claim 1, wherein a value of voltage at a junction of said second transistor with said ground is sensed while said first transistor is conducting and at the same time said second transistor is non-conducting, and it is decided that there is abnormality in said air-fuel ratio control system when the sensed voltage value falls outside a predetermined range.

9. A method as claimed in claim 1, wherein a value of voltage at a junction of said second transistor with said ground is sensed while said first transistor is non-conducting and at the same time a predetermined amount of current is applied to a base of said second transistor, and it is decided that there is abnormality in said air-fuel ratio control system when the sensed voltage value falls outside a predetermined range.

10. A method as claimed in claim 2, 3, 4, 5, 7, 8 or 9, wherein said sensing of the voltage value is effected when said proportional control valve is inoperative.

11. A method as claimed in claim 7 or claim 9, wherein said predetermined amount of current has such a value as to keep said proportional control valve substantially closed.

12. A method as claimed in claim 1, 2, 3, 4, 5, 6, 7, 8 or 9, wherein said sensing of the voltage value is effected when the engine is in a state other than a cranking state.

13. A method of detecting abnormality in an air-fuel ratio control system for an internal combustion engine, said air-fuel ratio control system having a proportional control valve arranged in an air supply passage for supplying secondary air therethrough to the engine and controlled in response to an output signal from an oxygen concentration sensor arranged in an exhaust system of the engine in a manner such that a valve opening thereof varies in proportion to the magnitude of driving current supplied thereto, the method comprising the steps of:

(1) providing a circuit including a first transistor, said proportional control valve, and a second transistor, said control valve being connected between said first and second transistors, said first transistor, control valve and second transistor being serially connected with each other between a power source for supplying a predetermined voltage and ground;

(2) sensing a value of voltage at a predetermined location in said circuit while said first and second transistors are in predetermined states of conduction and non-conduction;

(3) determining whether there is abnormality in said air-fuel ratio control system, on the basis of the sensed voltage value;

(4) holding said first transistor in a non-conducting state when the engine is starting in a state other than a predetermined hot state;

(5) determining whether it was determined at said step (3) that there was abnormality in said air-fuel ratio control system, during immediately preceding operation of the engine before the engine stops; and (6) causing said first transistor to conduct when the engine is starting in said predetermined hot state when it is determined at said step (5) that there was no abnormality in said air-fuel ratio control system during said immediately preceding operation of the engine.

* * * * *